US011051592B2

(12) United States Patent
Barnett

(10) Patent No.: US 11,051,592 B2
(45) Date of Patent: Jul. 6, 2021

(54) BRACELET WITH EXPANDABLE ELEMENT

(71) Applicant: PopSockets LLC, Boulder, CO (US)

(72) Inventor: David B. Barnett, Boulder, CO (US)

(73) Assignee: POPSOCKETS LLC, Boulder, CO (US)

( * ) Notice: Subject to any disclaimer, the term of this patent is extended or adjusted under 35 U.S.C. 154(b) by 6 days.

(21) Appl. No.: 16/788,166

(22) Filed: Feb. 11, 2020

(65) Prior Publication Data

US 2020/0253341 A1 Aug. 13, 2020

Related U.S. Application Data

(60) Provisional application No. 62/704,058, filed on Feb. 11, 2019.

(51) Int. Cl.
*A44C 5/00* (2006.01)
*A44C 15/00* (2006.01)

(52) U.S. Cl.
CPC ..... *A44C 5/0023* (2013.01); *A44C 5/0053* (2013.01); *A44C 15/005* (2013.01)

(58) Field of Classification Search
CPC ... A44C 5/0023; A44C 5/0053; A44C 15/005; A44C 5/0007; A44C 15/003; A44C 5/00
USPC ..... 273/457, 458; 446/183–185, 198–199, 446/267; 63/1.11, 1.14
See application file for complete search history.

(56) References Cited

U.S. PATENT DOCUMENTS 1,567,973 A * 12/1925 Mendelson ..... A63H 13/16 446/198
2,668,394 A * 2/1954 Auzin ..... A63H 3/24 446/183

FOREIGN PATENT DOCUMENTS

GB 633641 A * 12/1949 ..... A63H 3/48

* cited by examiner

*Primary Examiner* — Jack W Lavinder
(74) *Attorney, Agent, or Firm* — Irell and Manella, LLP

(57) ABSTRACT

An accessory includes a band member and a button. The band member includes an elongated body defining a band interior cavity containing a fluid (gas or liquid) and further includes a band contact region formed along a length of the elongated body. The button has top and bottom portions and a body extending therebetween. The bottom portion is operably coupled to the band member. The body defines a button interior cavity that is in fluid communication with the band interior cavity, and further includes an expandable mechanism that includes first and second ends and a longitudinal axis. The expandable mechanism is movable between an expanded configuration and a collapsed configuration to selectively move the button between an expanded position and a collapsed position. Upon engaging the band contact region, the fluid urges the button to the expanded position.

16 Claims, 4 Drawing Sheets

BRACELET WITH EXPANDABLE ELEMENT

CROSS-REFERENCE TO RELATED APPLICATIONS

Priority is claimed to U.S. Provisional Patent Application No. 62/704,058, filed Feb. 11, 2019, the entire contents of which are hereby incorporated herein by reference

FIELD OF THE DISCLOSURE

The present disclosure generally relates to an accessory device and, more particularly, to accessory devices having expandable elements.

BACKGROUND

People may turn to playing or fiddling with their hands as a way to release nervous energy, anxiety, and/or stress. Some devices may assist in alleviating this stress by providing a mechanism that allows an individual to redirect their energy. These devices may vary in size, and in some cases may be easily misplaced by the user.

SUMMARY

In one or more embodiments, an accessory comprises a band member including an elongated body, the elongated body defining a band interior cavity containing a fluid and including a band contact region formed at a position along a length of the elongated body. The accessory further includes a button having a top portion, a bottom portion, and a body extending between the top portion and the bottom portion, the bottom portion of the button being operably coupled to the band member, the body defining a button interior cavity in fluid communication with the band interior cavity and further includes an expandable mechanism, wherein the expandable mechanism comprises a first end, a second end, and a longitudinal axis, the expandable mechanism being movable between an expanded configuration and a collapsed configuration to selectively move the button between an expanded position and a collapsed position. Upon engaging the band contact region of the elongated body, the fluid urges the button to the expanded position.

Other aspects, features, and techniques of the invention will be apparent to one skilled in the relevant art in view of the following detailed description of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

Figure 1:
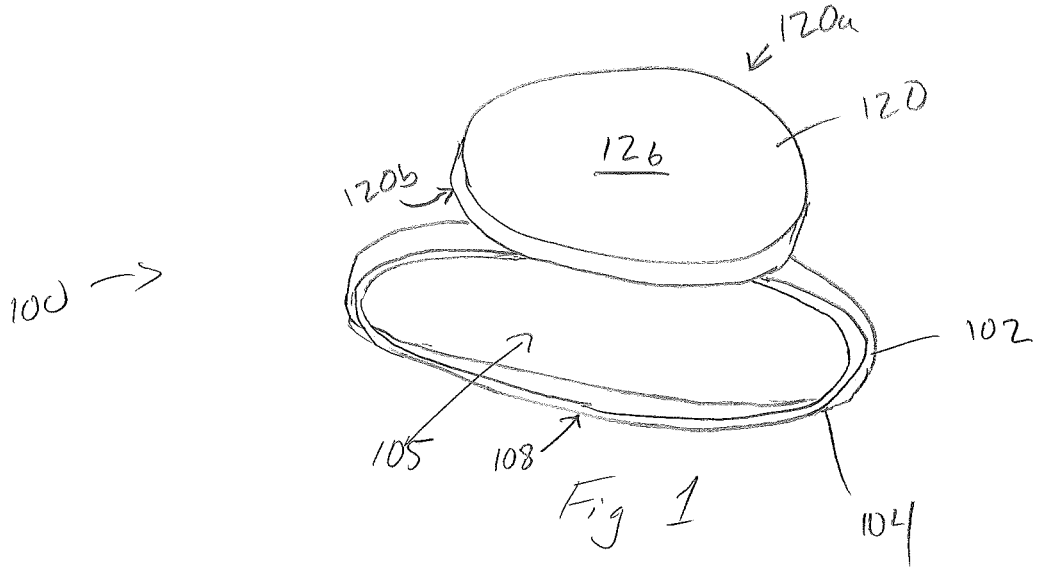
FIG. 1 illustrates a perspective view of an example accessory in a collapsed configuration in accordance with various embodiments.
Figure 2:
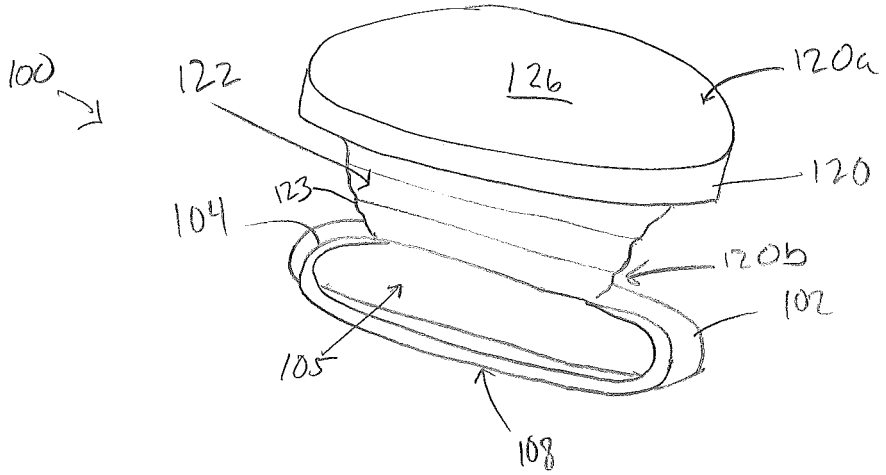
FIG. 2 illustrates a perspective view of the example accessory of FIG. 1 in an expanded configuration in accordance with various embodiments.
Figure 3:
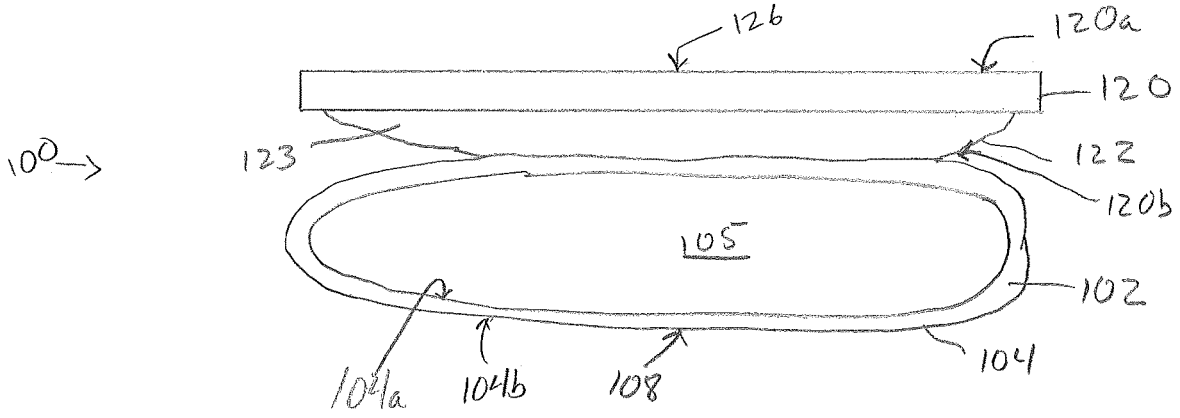
FIG. 3 illustrates a front elevation view of the example accessory of FIGS. 1 and 2 in accordance with various embodiments.
Figure 4:
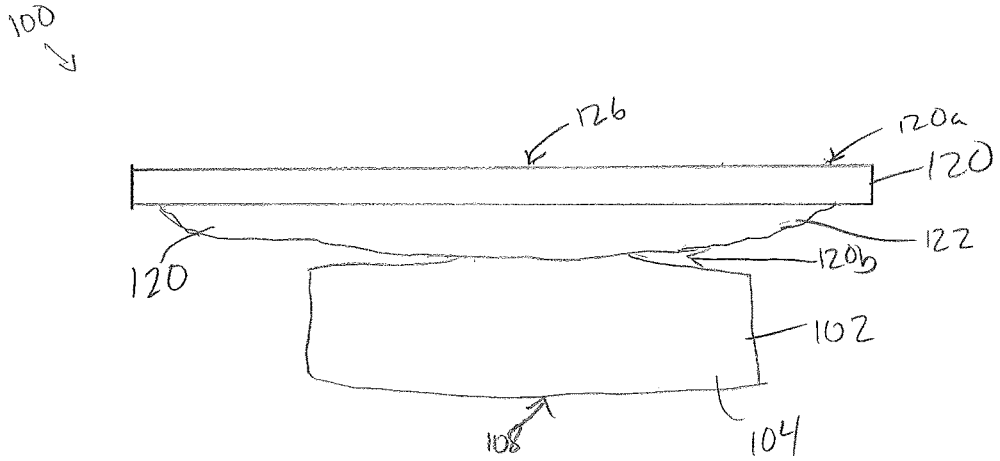
FIG. 4 illustrates a side elevation view of the example accessory of FIGS. 1-3 in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

One aspect of the following disclosure relates to accessory devices that may be worn by a user as a bracelet, necklace, anklet, or other accessory. Generally an expandable accessory device includes a band member having an opening sized to accommodate the user's arm, hand, neck, and like, and an expandable mechanism that allows the device to be configured in different arrangements. These expandable mechanisms may be used to provide a gripping and/or storage mechanism for a user. Some of these expandable devices are adapted to accommodate releasable buttons via a release mechanism, each of which may be adorned with different decorative buttons displaying logos, decals, symbols, and/or other artistic renderings.

Another aspect of the disclosure is an accessory that includes a band member and a button. The band member includes an elongated body that defines a band interior cavity containing a fluid (e.g., a gas or liquid) and further includes a band contact region formed at a position along a length of the elongated body. The band member may be in the form of a bracelet and/or a necklace. The button has top and bottom portions and a body extending therebetween. The bottom portion is operably coupled to the band member. The body defines a button interior cavity that is in fluid communication with the band interior cavity, and further includes an expandable mechanism that includes first and second ends and a longitudinal axis. The expandable mechanism is movable between an expanded configuration and a collapsed configuration to selectively move the button between an expanded position and a collapsed position. Upon engaging the band contact region of the elongated body, the fluid urges the button to the expanded position.

In some approaches, the button may further include a button contact region. Upon engaging the button contact region, the button is moved to the collapsed position. In some examples, at least one of the expandable mechanism or the fluid urges the button to the collapsed position. In some examples, upon engaging the band contact region, the fluid at least partially flows between the band interior cavity and the button interior cavity.

In these and other examples, at least a portion of the band member and at least a portion of the button are constructed from a resilient material. The band contact region may have a resilience that is different than a resilience of the remainder of the elongated body.

In some forms, the accessory device may include a bistable expandable member that is at least partially positioned between the top portion of the button and the bottom portion of the button. The bistable expandable member selectively retains the button in the collapsed position or the expanded position. Further, in some examples, the accessory may include a valve member that selectively restricts fluid flow between the band interior cavity and the button interior cavity. In some examples, the expandable mechanism may be in the form of at least one of a bellows member, a telescoping member, a spring member, or a foam member.

In accordance with an additional aspect of the disclosure, an approach for operating an accessory in the form of a band member that defines a band interior cavity containing fluid and a button defining a button interior cavity that is in fluid communication with the band interior cavity includes engaging a band contact region of the band member to cause the fluid retained within the band interior cavity to be urged towards the button interior cavity to position the button in an expanded position. A button contact region of the button is engaged to position the button in a collapsed position.

With reference now to the figures, an accessory device 100 is shown that includes a band member 102 including an elongated body 104 and a button 120 having a top or upper portion 120*a*, a bottom or lower portion 120*b*, and a body 122 extending between the top portion 120*a* and the bottom portion 120*b*. The bottom portion 120*b* is operably coupled to the elongated body 104 and, in some examples, may be integrally formed therewith. In the illustrated example, the body 122 is in the form of a collapsible and/or expandable mechanism 123.

The elongated body 104 of the band member 102 is generally circular and defines a hole 105 dimensioned to allow a user's hand, foot, head, or other extremity to be passed therethrough to allow the accessory 100 to be worn. As such, the elongated body 104 may be constructed from an elastic or otherwise resilient material (e.g., a rubberized material, a fabric material, etc.) that stretches to accommodate objects having a larger dimension than a dimension (e.g., a diameter) of the hole 105. The elongated body 104 is generally tubular and/or hollow in cross-section (see FIG. 5) and defines an innermost portion 104*a*, an outermost portion 104*b*, and a band interior cavity 106 defined by the innermost and outermost portions 104*a*, 104*b*. In other words, a portion or all of the elongated body 104 may be in the form of an air bladder.

The elongated body 104 further includes a band contact region 108 formed along a length thereof. In the illustrated example, the band contact region 108 may be all or any portion of an overall length of the elongated body 104. Further, the band contact region 108 is generally disposed on an outermost portion 104*a* of the elongated body, which is generally a surface positioned furthest from a central axis of the hole 105. The band contact region 108 may be more resilient, less resilient, or equally as resilient as the remainder of the elongated body 104, and may be constructed from the same or different materials as the remainder of the elongated body 104.

As previously noted, the top or upper portion 120*a* of the button 120 may have an annular shape. In other examples, however, the top portion 120*a* of the button 120 may have a rectangular, square, triangular, irregular, or other shape. The top portion 120*a* of the button 120 in this example also has an outer diameter that is larger than an outer diameter of the bottom portion 120*b* of the button 120, though this need not be the case. The button 120 is preferably constructed from metal or plastic material, though other suitable materials can be used. The top portion 120*a* of the button 120 further includes a button contact region 126 formed along a length thereof. In the illustrated example, the button contact region 126 may be all or any portion of an upper surface of the button 120, though other examples are possible.

The button 120 may have artistic value (e.g., the button 120 may include an artistic rendering, a logo, a symbol, text, or a decal), the button 120 may provide a grip that allows a user to slide their fingers around the body 122 when the body 122 is in the expanded configuration to allow for storage of cords, bands, or other items either around the outer surface of the body 122 or inside a compartment in the body 122.

Figure 5:
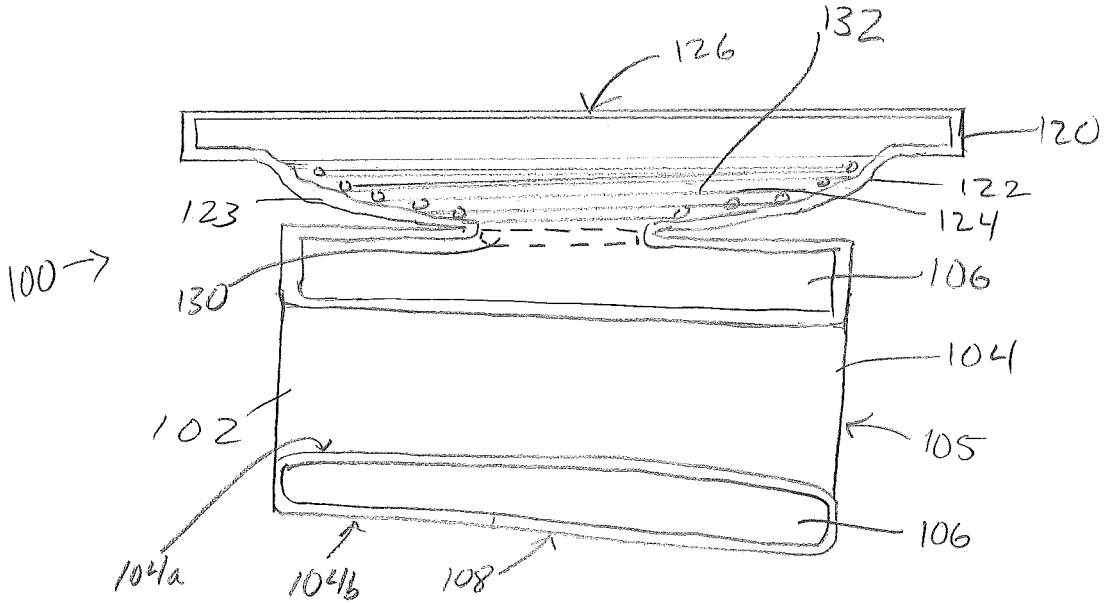
FIG. 5 illustrates a cross-sectional view of the example accessory of FIGS. 1-4 in accordance with various embodiments.

The expandable mechanism 123 of the button 120 generally is movable between an expanded and collapsed configuration to facilitate movement of the accessory 100 between an expanded position and a collapsed position, and also retains the accessory 100 in the desired position (expanded or collapsed) when worn by the user. The expandable mechanism 123 may take the form of an outer case, an enclosure, a shell, and/or a deformable cover such as a bellows-shaped member, a telescoping member, a spring member, and/or a foam member, and additionally defines a button interior cavity 124. As shown in FIG. 5, the band interior cavity 106 is open to (i.e., in fluid communication with) the button interior cavity 124 such that a fluid (e.g., a compressible and/or incompressible gases and/or liquids such as air, water, etc.) may flow between the two cavities 106, 124.

Figure 6:
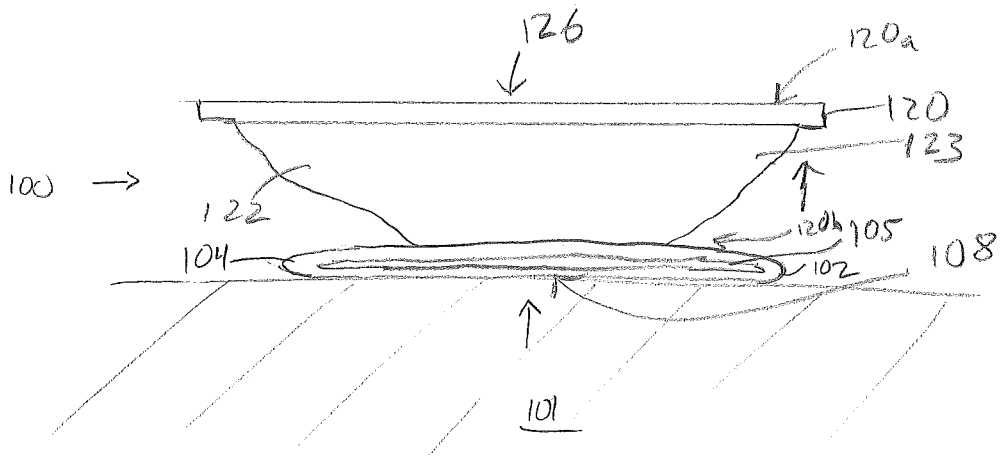
FIG. 6 illustrates a front elevation view of the example accessory of FIGS. 1-5 during a transition from the collapsed configuration to the expanded configuration in accordance with various embodiments.
Figure 7:
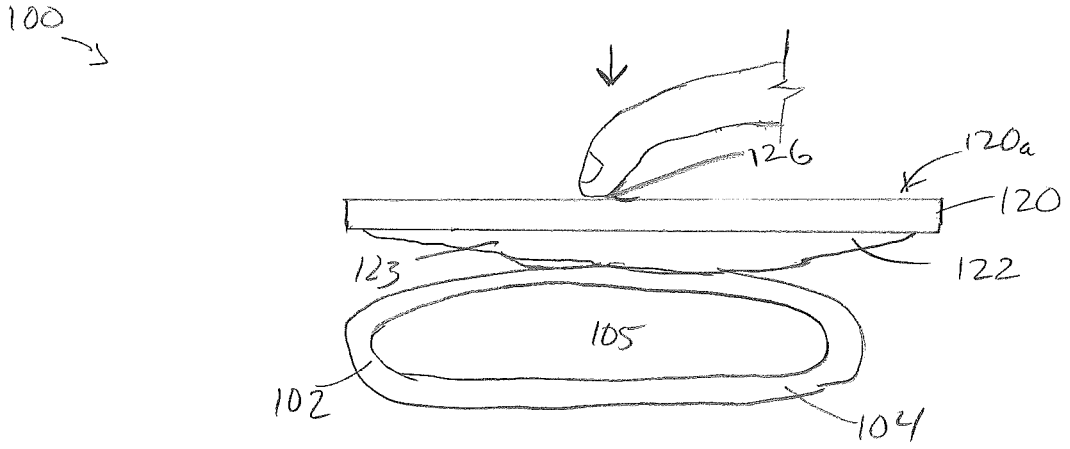
FIG. 7 illustrates a front elevation view of the example accessory of FIGS. 1-6 during a transition from the expanded configuration to the collapsed configuration in accordance with various embodiments.

Turning to FIGS. 6 and 7, to operate the device 100, a user may engage the band contact region 108 to cause the expandable mechanism 123 to move to the expanded configuration. Specifically, as shown in FIG. 6, upon inserting their hand, wrist, and/or arm through the hole 105, a user may contact (e.g., slap or strike) the band contact region 108 of the elongated body 104 against a surface 101 such as their hand, a table, etc., which causes at least a portion of the elongated body 104 to deform and compress due to its construction. This contact with the surface 101 causes the volume of the band interior cavity 106 to decrease, and as a result, forces the fluid contained within the band interior cavity 106 to be urged towards the button interior cavity 124. Accordingly, the increased fluid in the button interior cavity 124 generates an urging force that causes the expandable mechanism 123 to expand outwardly to the expanded configuration, thereby moving the button to the expanded position.

To configure the device in the collapsed position, as illustrated in FIG. 7, a user may press or otherwise urge the button contact region 126 in a direction towards the bottom portion 120*b* of the button 120. Alternatively or additionally, a user may slap and/or strike the button contact region 126 using a surface such as a table or other object. Such contact with the button contact region 126 causes the volume of the button interior cavity 124 to decrease, and as a result, forces the fluid contained within the button interior cavity 124 to be urged towards the band interior cavity 106. Accordingly, the increased fluid in the band interior cavity 106 causes the elongated body 104 to increase in volume to accommodate the additional fluid. In some examples, the expandable mechanism 123 may assist in (or be entirely responsible for) causing the button 120 to move to the collapsed position.

In some examples, the band interior cavity 106 and the button interior cavity 124 are sealed or closed to an external environment such that fluid contained within the cavities 106, 124 may not escape. As a result, the device 100 may reach an equilibrium internal pressure after the band contact region 108 and/or the button contact region 126 are contacted to selectively configure the expandable mechanism 123 in the expanded or collapsed configuration. In other words, contact with the band contact region 108 and/or the button contact region 126 may result in a temporary urging force that is large enough to overcome any forces acting to maintain the expandable mechanism 123 in the expanded or collapsed configuration, but this force may dissipate after contact with the band contact region 108 and/or the button contact region 126 is removed. As a result, the elongated body 104 of the band member 102 may return to a "relaxed" configuration after contact is made with the band contact region 108. In some examples, the band interior cavity 106 and/or the button interior cavity 124 may be opened to an external environment via a bleed hole or other mechanism formed on the band member 102 and/or the button 122.

In some approaches, the accessory 100 may include any number of optional arrangements, configurations, and/or components. For example, the band member 102 may be in the form of an elongated spring steel member that has no opening or annular shape in its expanded state. In other words, the band member may be generally planar and/or flat. However, upon exerting a force on a portion of the elongated body, the elongated body may begin to "curl" upon itself until forming a partial or full opening. In these examples, an air bladder may be coupled to a portion of the elongated spring steel member to assist in urging the button to an expanded position. In other examples, the band member may be a highly flexible material that lacks a constant shape when not disposed on a user's wrist (or leg, neck, etc.).

Further, in some approaches, a valve member 130 may be optionally implemented in the accessory 100. As illustrated in FIG. 5, the valve member 130 may be positioned between the elongated body 104 and the bottom portion 120*b* of the button 120. The valve member 130 may be used to selectively restrict fluid flow between the band interior cavity 106 and the button interior cavity 124. Accordingly, the valve member 130 may take any number of forms such as, for example, a flap valve, a ball valve, a duckbill valve, and/or any other one-way or two-way valve members. Such a configuration may assist in maintaining the expandable mechanism 123 in the expanded or collapsed configuration.

In some aspects, the expandable mechanism 123 may include a bistable element or member 132 operatively coupled to the button 120. For example, a bistable member (e.g., a spring or other mechanism) 132 may be positioned between the top portion 120*a* of the button 120 and the bottom portion 120*b* of the button 120. In some examples, the bistable member 132 may be disposed partially and/or fully within the body 122 of the button 120, and in other examples, the bistable member 132 may be disposed partially and/or fully outside the body 122 of the button 120 (not shown). In yet other examples, the expandable mechanism 123 itself may be the bistable element 132. The bistable member 132 may assist in retaining the expandable mechanism 123 in the expanded or the collapsed configuration. For example, the bistable member 132 may have two stable states in which it resists movement (at least initially).

Further, the bistable member 132 may assist in moving the expandable mechanism 123 between the expanded and collapsed configurations to position the button in the expanded or collapsed position. For example, upon overcoming an initial resistance when configured in the expanded or collapsed configuration, the bistable member 132 may then exert a force on the expandable mechanism 123 that collapses or expands the expandable mechanism 123. It is noted that in some examples, when the bistable member 132 assists in moving the expandable mechanism 123 to the collapsed configuration, the bistable member 132 may cooperate with any forces generated by the fluid that act to move the expandable mechanism 123. In other examples, the bistable member may be solely responsible for generating any forces that urge the expandable mechanism 123 to the collapsed configuration.

In some examples, alternative devices may be provided that include a release mechanism to allow the button 120 to be selectively decoupled from the band member 102 and/or a portion of the button 120 to be selectively decoupled from another portion of the button 120. In some instances, the aforementioned expandable mechanism, collapsible mechanism, and/or release mechanism may by as described in as disclosed in any one or more of: U.S. Pat. No. 8,560,031, filed on Feb. 23, 2012; U.S. Pat. No. 9,970,589, filed on Nov. 9, 2017; U.S. application Ser. No. 15/615,900, filed on Jun. 7, 2017 (now U.S. Pat. No. 10,054,259); U.S. application Ser. No. 15/679,934, filed on Aug. 17, 2017 (now U.S. Pat. No. 10,060,573); U.S. application Ser. No. 15/803,410, filed on Nov. 3, 2017 (now U.S. Pat. No. 9,958,107); U.S. application Ser. No. 15/808,076, filed on Nov. 9, 2017 (now U.S. Pat. No. 9,970,589); U.S. application Ser. No. 15/864,402, filed on Jan. 8, 2018 (published as US 2019/0138052); U.S. application Ser. No. 15/864,509, filed on Jan. 8, 2018 (now U.S. Pat. No. 10,463,116); U.S. application Ser. No. 15/906,920, filed on Feb. 27, 2018 (now U.S. Pat. No. 10,215,329); U.S. application Ser. No. 15/922,601, filed on Mar. 15, 2018 (now U.S. Pat. No. 10,030,807); U.S. application Ser. No. 15/952,025, filed on Apr. 12, 2018 (now U.S. Pat. No. 10,386,009); U.S. application Ser. No. 15/993,458, filed on May 30, 2018 (now Patent No. U.S. Pat. No. 10,348,352); and U.S. application Ser. No. 16/001,723, filed on Jun. 6, 2018 (now U.S. Pat. No. 10,317,005), the entirety of each is hereby incorporated by reference.

While the invention has been described in connection with various embodiments, it will be understood that the invention is capable of further modifications. This application is intended to cover any variations, uses or adaptation of the invention following, in general, the principles of the invention, and including such departures from the present disclosure as, within the known and customary practice within the art to which the invention pertains.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. An accessory comprising:

a band member including an elongated body, the elongated body defining a band interior cavity containing a fluid and including a band contact region formed at a position along a length of the elongated body; and a button having a top portion, a bottom portion, and a body extending between the top portion and the bottom portion, the bottom portion of the button being operably coupled to the band member, the body defining a button interior cavity in fluid communication with the band interior cavity and further includes an expandable mechanism, wherein the expandable mechanism comprises a first end, a second end, and a longitudinal axis, the expandable mechanism being movable between an expanded configuration and a collapsed configuration to selectively move the button between an expanded position and a collapsed position, wherein upon engaging the band contact region of the elongated body, the fluid urges the button to the expanded position.

2. The accessory of claim 1, wherein the button further comprises a button contact region, wherein upon engaging the button contact region, the button is moved to the collapsed position.

3. The accessory of claim 2, wherein the expandable mechanism and/or the fluid urges the button to the collapsed position.

4. The accessory of claim 1, wherein upon engaging the band contact region, the fluid at least partially flows between the band interior cavity and the button interior cavity.

5. The accessory of claim 1, wherein at least a portion of the band member and at least a portion of the button are constructed from a resilient material.

6. The accessory of claim 5, wherein the band contact region has a resilience that is different than a resilience of the remainder of the elongated body.

7. The accessory of claim 1, further comprising a bistable expandable member at least partially positioned between the top portion of the button and the bottom portion of the button, wherein the bistable expandable member selectively retains the button in the collapsed position or the expanded position.

8. The accessory of claim 1, further comprising a valve member to selectively restrict flow of the fluid between the band interior cavity and the button interior cavity.

9. The accessory of claim 1, wherein the band member comprises a bracelet.

10. The accessory of claim 1, wherein the band member comprises a necklace.

11. The accessory of claim 1, wherein the expandable mechanism comprises at least one of:

a bellows member, a telescoping member, a spring member, or a foam member.

12. A method of operating an accessory comprising a band member defining a band interior cavity containing a fluid and a button defining a button interior cavity, the band interior cavity in fluid communication with the button interior cavity, the method comprising:

engaging a band contact region of the band member to cause the fluid retained within the band interior cavity to be urged towards the button interior cavity to position the button in an expanded position; and engaging a button contact region of the button to position the button in a collapsed position.

13. The method of claim 12, wherein the fluid at least partially flows between the band interior cavity and the button interior cavity.

14. The method of claim 12, wherein at least a portion of the band member and at least a portion of the button are constructed from a resilient material.

15. The method of claim 12, further comprising positioning a bistable expandable member at least partially positioned between a top portion of the button and a bottom portion of the button to selectively retain the button in the collapsed configuration or the expanded configuration.

16. The method of claim 12, further comprising selectively restricting, via a valve member, flow of the fluid between the band interior cavity and the button interior cavity.

* * * * *